United States Patent [19]

Stern et al.

[11] 4,179,742

[45] Dec. 18, 1979

[54] SYSTEM FOR INTELLIGENTLY SELECTING THE MODE OF CONTROL OF A POWER PLANT

[75] Inventors: Louis P. Stern, Wadsworth, Ohio; Steven J. Johnson, McCandless Township, Allegheny County, Pa.

[73] Assignee: Westinghouse Electric Corp., Pittsburgh, Pa.

[21] Appl. No.: 894,073

[22] Filed: Apr. 6, 1978

[51] Int. Cl.[2] ..... G05B 15/02; F01D 17/02

[52] U.S. Cl. ..... 364/494; 290/40 R; 60/660

[58] Field of Search ..... 364/492, 493, 494; 290/40 R; 60/660

[56] References Cited

U.S. PATENT DOCUMENTS

| | | | |
|---|---|---|---|
| 3,448,581 | 6/1969 | Nettel | 60/67 |
| 3,925,645 | 12/1975 | Stern | 290/40 R X |
| 3,939,328 | 2/1976 | Davis | 290/40 R X |
| 3,956,897 | 5/1976 | Zitelli | 60/660 |
| 4,027,145 | 5/1977 | McDonald | 290/40 R X |

*Primary Examiner*—Edward J. Wise

*Attorney, Agent, or Firm*—W. E. Zitelli

[57] ABSTRACT

A system for intelligently governing the selection of one of a boiler follow or turbine follow mode of control of a steam turbine power plant is disclosed. Boiler and turbine master controllers are concurrently operative in one of the boiler follow and turbine follow modes for controlling the firing rate of the plant boiler or positioning the steam admission valves of the steam turbine, respectively. Each of the boiler and turbine master controllers are operative to respectively generate a first and second plurality of signals which are representative of plant control status. A selecting means is disposed as an integral part of the plant controls for switching between the turbine follow and boiler follow control modes. Accordingly, the disclosed system intelligently governs the selecting means to switch the plant control to the boiler follow mode in accordance with a first set of predetermined plant control conditions and to switch the plant control to the turbine follow mode in accordance with a second set of predetermined plant control conditions wherein the first and second sets of predetermined plant control conditions are established from the first and second plurality of signals.

10 Claims, 2 Drawing Figures

SYSTEM FOR INTELLIGENTLY SELECTING THE MODE OF CONTROL OF A POWER PLANT

BACKGROUND OF THE INVENTION

The present invention relates broadly to steam turbine power plant control systems, and more particularly to a system which intelligently selects or rejects power plant control modes based on the status of predetermined plant conditions.

Generally, the electrical energy generated from a steam turbine power plant is controlled at a desired power generation level in response to a power generation demand signal modulated by either a power plant operator via an operator's panel or a network dispatcher via an automatic dispatch system (ADS). In accomplishing this control, the power plant may be operated typically in one of a boiler follow mode and a turbine follow mode. Usually, the automatic dispatch system is operated in combination with the controlling turbine follow or boiler follow mode. When the plant control is in the boiler follow mode, the turbine steam admission valves are positioned to admit steam through the steam turbine corresponding to the power generation demand signal and the boiler throttle pressure which is influenced by the steam flow is generally maintained at a desired value by adjusting the boiler firing rate. Similarly, when in the turbine follow mode, the boiler firing rate is controlled to generate steam from the boiler at a rate corresponding to the power generation demand signal and the steam admission valves are positioned to admit steam in response to the boiler firing rate adjustment by maintaining boiler throttle pressure substantially at a desired level.

Previous systems such as that described in U.S. Pat. No. 3,925,645 entitled "System And Method for Transferring Between Boiler-Turbine Plant Control Modes" issued to L. P. Stern on Dec. 9, 1975 and assigned to the same assignee as the present application, have required the plant operator to select the control modes by depressing certain specified push buttons on the operator's panel. This meant that a plant operator would have to be knowledgeable of most of the operational conditions and limitations of the power plant which are sometimes quite subtle and be capable of recognizing those under which the plant may better be controlled in the boiler follow mode and those under which the plant may better be controlled in the turbine follow mode. The plant operator would then take action accordingly. Of course, if certain plant conditions and limitations pass unrecognized, the plant may be operated in a mode which offers undesirable plant protection and/or inefficient plant control which at times may even result in the inability to achieve maximum generated output.

It would be desirable to remove this responsibility from the plant operators and ultimately free them to perform even more supervisory tasks which could result in greater power generation plant availability. By including some known intelligence of plant conditions in the mode selection logic, similar to that of U.S. Pat. No. 3,925,645, it may be possible to acquire an automatic selection of modes which would thereby relieve operator attentiveness in these situations. Such a system is proposed hereinbelow.

SUMMARY OF THE INVENTION

In a steam turbine power plant which is operative in one of a boiler follow and turbine follow control mode, a system is disposed for intelligently governing the selection of one of the boiler follow and turbine follow control modes. More specifically, the power plant includes a boiler for generating steam and a boiler master controller for controlling the firing rate thereof; a steam turbine having a plurality of steam admission valves for regulating the generated steam therethrough and a turbine master controller for controlling the steam admission valves; and an electrical generator mechanically coupled to the steam turbine for generating electrical energy at a desired power generation level. Each of the boiler and turbine master controllers are operative to respectively generate a first and second plurality of status signals which are representative of plant control status. The boiler and turbine master controllers are concurrently operative to control the power plant in one of the turbine follow and boiler follow modes. The power plant additionally includes a selecting means for switching the mode of control thereof between the boiler follow and turbine follow modes. Accordingly, the system intelligently governs the selecting means to switch plant control to the boiler follow mode in accordance with a first set of predetermined plant control conditions and to switch plant control to the turbine follow mode in accordance with a second set of predetermined plant control conditions, both the first and second sets of predetermined plant control conditions being established from said generated first and second plurality of plant status signals. In another aspect, the boiler and turbine master controllers are governed by a power generation demand signal which is modulated from a selected one of either a plant control panel or an automatic dispatch system (ADS), the ADS selection being dependent upon a set of predetermined permissives. Still further, the selection of the ADS is rejected as a result of a detected invalid signal generation condition.

DESCRIPTION OF THE PREFERRED EMBODIMENT

Figure 1:
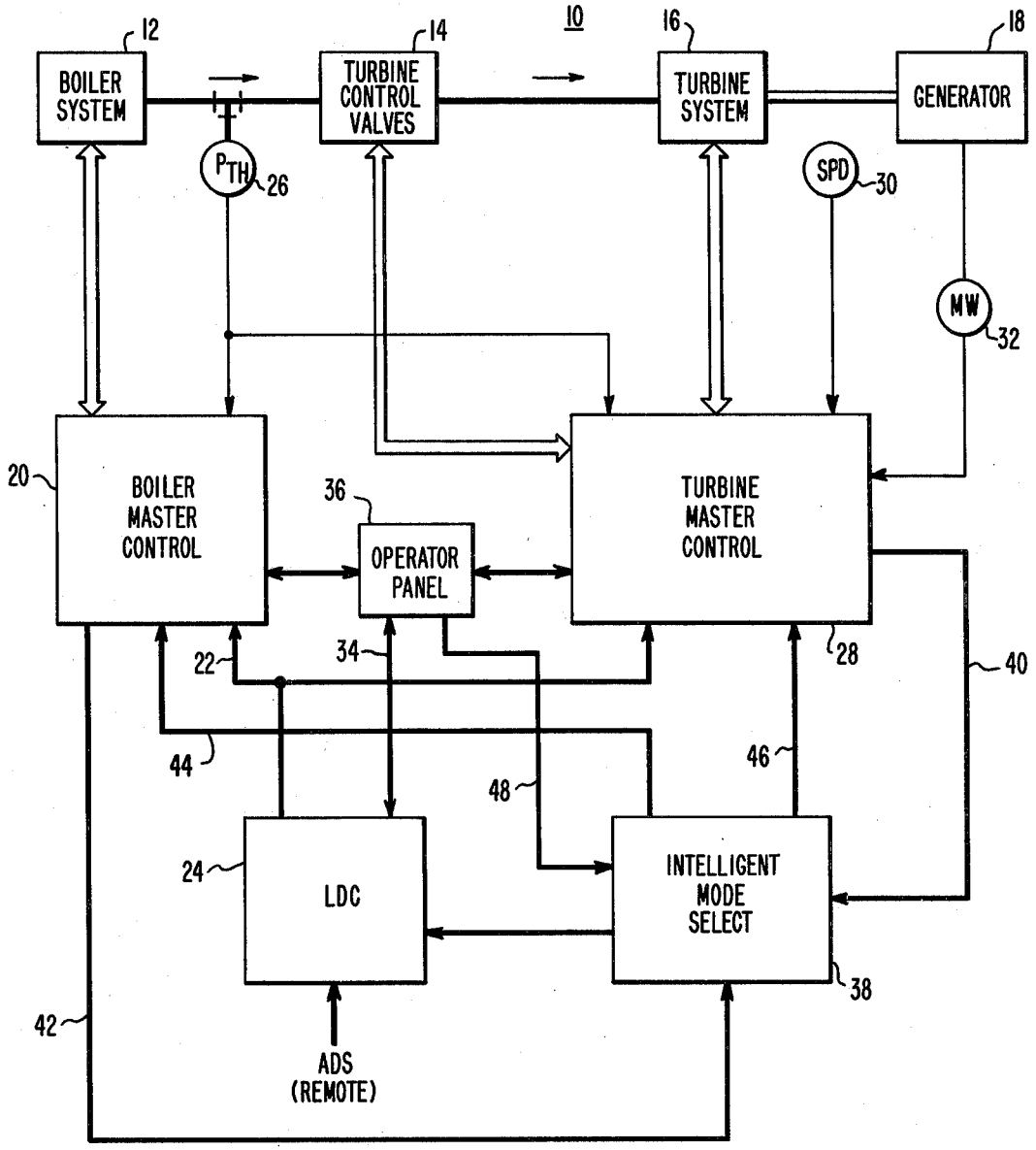
FIG. 1 is a schematic block diagram of a steam turbine power plant suitable for embodying the principles of the present invention.

The environment in which the principles of the invention is preferably embodied may be described in connection with a steam turbine power plant 10, such as that shown in FIG. 1, which produces electrical energy at a desired power generation level. As part of the operation of the power plant 10, steam is generated in a conventional boiler system 12 and is presented to a plurality of steam admission valves 14 at a boiler throttle pressure $P_{th}$. The steam admission valves 14 may be disposed in any number of typical valve arrangements for regulating steam through a steam turbine system 16 which is mechanically coupled to drive an electrical generator 18 to provide electrical energy to a system load (not shown). A boiler master controller 20 which may be a well-known type is operative to control the firing rate of the boiler by adjusting certain boiler parameters such as fuel and air mixtures and feedwater flow. The boiler master controller 20 further includes various boiler auxiliaries to control the boiler accessories such as fans, coal feeders and feedwater pumps, for example, which are normally associated with boiler control operation. In the turbine follow mode of control, the boiler controller 20 may be governed by a power generation demand signal 22 which is generated from a load demand computer 24 in a manner well known to those skilled in the art. In the boiler follow mode of control, the boiler controller 20 utilizes a boiler throttle pressure set point controller (see below for a more detailed description) to trim the demand signal 22 to maintain the boiler throttle pressure $P_{th}$ as measured by a typical pressure transducer 26 at a desired set point setting.

A turbine master controller 28 which may also be a well-known type is also operative in the control of the power plant 10 to adjust the positions of the steam admission valves. The turbine master controller 28 utilizes certain measured plant parameters such as the rotating speed of the turbine, the value of which is coupled to the controller 28 from a conventional speed transducer 30; and the generated power level, which is provided to the controller 28 from a typical watt transducer 32, to determine the valve positions. When in the boiler follow control mode, the turbine controller 28 is governed by the generated demand signal 22 and when in the turbine follow mode of control, the generated signal 22 is trimmed in the turbine controller 28 by a boiler throttle pressure set point controller (see below for a more detailed description) to maintain the throttle pressure signal measured from transducer 26 at a desired pressure set point.

The power generation demand signal 22 may be adjusted through the load demand computer 24 in accordance with either inputs 34 supplied from a conventional operator's control panel 36 or from an automatic dispatch system ADS which is conventionally coupled from a remote network dispatcher.

An intelligent mode select unit 38 is included as part of the plant control to monitor a plurality of status signals 40 and 42 which are representative of the plant control status of the turbine master controller 28 and the boiler master controller 20, respectively. The intelligent mode select unit 38 is operative to select one of either the boiler follow mode or a turbine follow mode of control operation in accordance with a plurality of predetermined plant control conditions established from the plant control status signals 40 and 42 which will be described in greater detail hereinbelow. Signals 44 and 46 are provided to the boiler master and turbine master controllers, 20 and 28, respectively to control the mode switching operations performed thereby. In addition, the unit 38 may be directed to select one of the boiler follow or turbine follow modes from push-button signal 48 derived from operator's panel 36. U.S. Pat. No. 3,925,645 issued to L. P. Stern on Dec. 8, 1975 is incorporated by reference in the present application for the purposes of providing a more detailed description of a system for transferring between boiler follow and turbine follow control modes related to mode switching operations performed in the boiler and turbine master control system.

Figure 2:
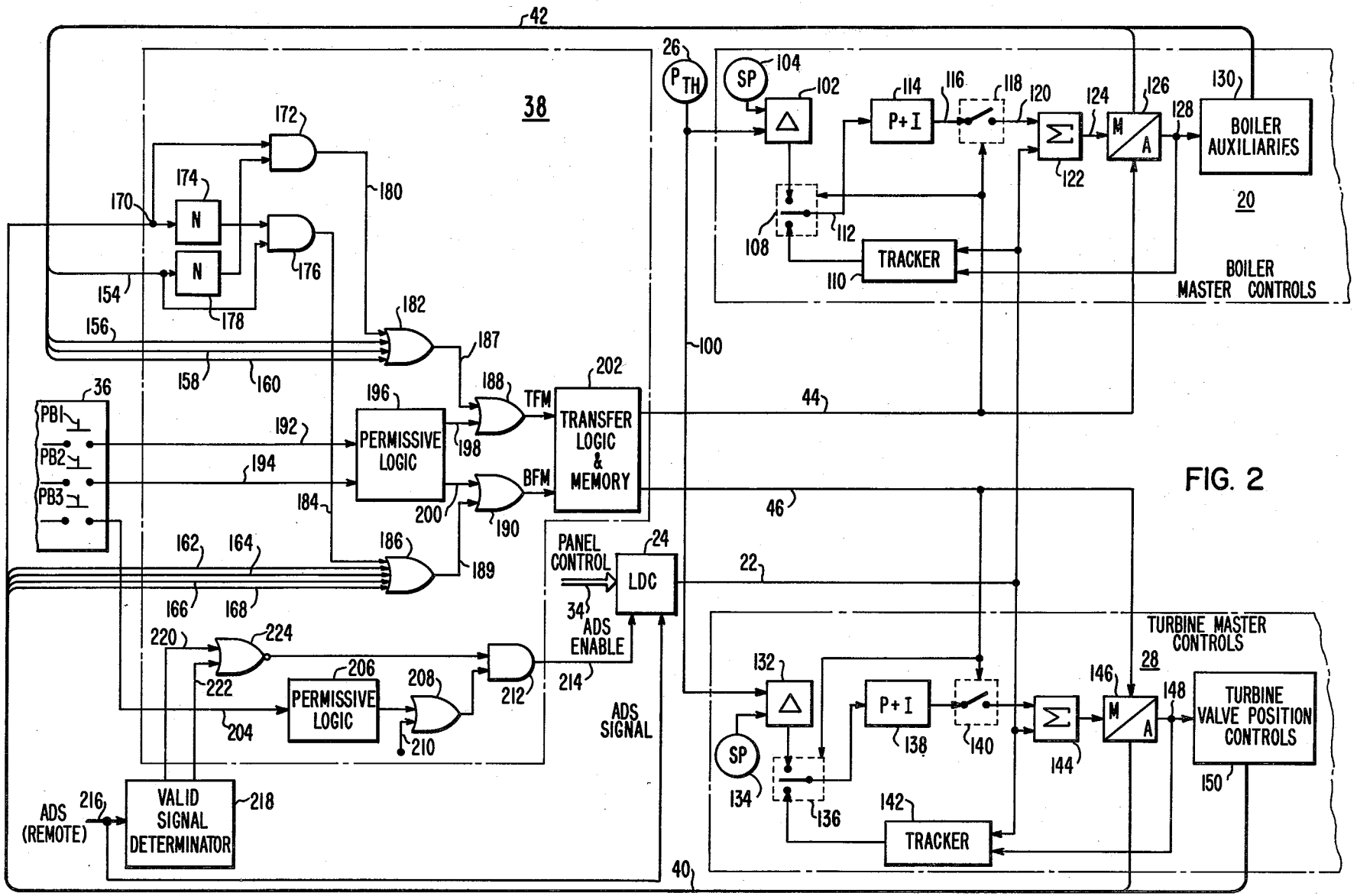
FIG. 2 is a functional schematic of an intelligent mode selecting unit and associated mode switching functions suitable for use in the embodiment of FIG. 1.

Referring to FIG. 2 for a more detailed schematic of a portion of the preferred embodiment, a signal 100 which is representative of the boiler throttle pressure $P_{th}$ as measured by the transducer 26 is supplied to a one input of a difference function 102 in the boiler master control 20. The other input of the difference function 102 is an adjustable set point signal 104. A signal 106 representative of the pressure error derived from the function 102 is provided to one input of a single-pole, double-throw (SPDT) switching function 108. Another input of the SPDT switch 108 is derived from a known tracking function 110. The pole 112 of the switch 108 is supplied as an input to a controller 114 which may be similar to a proportional plus integral type, the output signal 116 of which is coupled to the pole position of a single-pole single-throw (SPST) switching function 118. The other contact 120 of switch 118 is one input to a summer function 122, the output 124 of which is provided to a typical manual/automatic (M/A) station 126 as a conventional part of the boiler controls 20. Another input to the summer 122 is the power generation demand signal 22 derived from the load demand computer 24. The demand signal 22 is also supplied as one input to the tracker 110. A second input to the tracker 110 is connected to the output signal 128 of the M/A station 126. The signal 128 is a composite power generation demand signal governing the firing rate of the boiler 12 utilizing various conventional boiler auxiliaries 130 as described hereinabove.

The operation of the previously described portion of the boiler master control 20 is governed by the signal 44 which controls the switching between boiler follow and turbine follow modes. Briefly, when in the boiler follow mode of operation, signal 44 directs switch 112 to conduct the pressure error signal 106 to the controller 114 and directs switch 118 to permit the output 116 of controller 114 to be summed with the load demand signal 22 to effect the composite demand signal 124 which is passed on to the boiler auxiliaries by the M/A station 126 in the form of signal 128. When in the turbine follow mode, the boiler auxiliaries 130 are governed substantially by the load demand signal 22 and the signal 116 contributes effectively little to the composite signal 128. During the transfers between the turbine follow and boiler follow control modes, the switching functions 112 and 118 and tracker 110 are rendered operative in a time relationship by the signal 44, which may be representative of one or more control lines, to ensure substantially no deviation in plant power generation from that desired. A more detailed description of operation is found in U.S. Pat. No. 3,925,645 which has been incorporated by reference herein.

Similarly, the pressure signal 100 is provided to one input of a difference function 132 of the turbine master control 28. The other input of the difference function 132 is an adjustable set point signal 134. Well-known functions such as a SPDT switching function 136, a controller 138, a SPDT switching function 140, a tracking function 142, a summer 144 and a manual/automatic station 146 are disposed within the turbine master controller 28 in a similar arrangement as that described in connection with the boiler controls 20 presented hereinabove. Likewise, a generated composite load demand signal 148 is utilized to govern the convention valve position controls 150 of the turbine master controller 28. When in the boiler follow mode, the load demand signal 22 governs the positioning of the steam admission valves 14 of the turbine 16 as conducted by the valve position controls 150. Accordingly, when in the turbine follow mode, switching functions 136 and 140 and tracker 142 are directed by signal 46 to render the controller 138, which may also be of the proportional plus integral type, operative to affect a pressure trim signal 152 in response to the pressure error generated by the difference function 132. The pressure trim signal 152 is added to the load demand signal 22 to produce the composite demand signal 148 which governs the valve positioning as performed by unit 150. Transfers between the turbine follow and boiler follow modes are governed by the status of signal 46 which may be comprised of one or more control lines. These transfers are conducted in a time relationship to effect substantially no deviation in power generation away from that desired. For more details make reference to U.S. Pat. No. 3,925,645 cited above for incorporation by reference herein.

A plurality of plant control status signals are provided to the intelligent mode select unit 38 over signal lines 42. Exemplary of the type of information yielded by signal lines 42 are a signal 154 which in one state is representative of the boiler master controller 24 being operative in an automatic state; a signal 156 which in one state is representative of the boiler controller 20 being in a runback state as a result of a malfunction, for example; and signals 158 and 160 which are in one state representative of at least one boiler auxiliary of the conventional boiler auxiliaries 130 being controlled in an upper or lower limiting condition, respectively. Another plurality of plant control status signals are provided to the intelligent mode select unit 38 over signal lines 40 from the turbine master controller 28. Signal lines 40 may be comprised of signal 162 one state of which is representative of the turbine steam admission valves being substantially wide open; signal 164 which may provide an indication that the valve position of one or more steam admission valves is being limited; signal 166 which may indicate that the steam admission valves are being subjected to a boiler throttle pressure controller runback; signal 168 which in one state is representative of a turbine speed error has persisted outside desired speed regulatory operational limits beyond a fixed time duration; and signal 170 which in one state indicates that the turbine master controller 28 is operative in an automatic mode.

A logic arrangement of gating functions may be disposed within the unit 38 to establish from the plurality of plant control status signals over signal lines 40 and 42 sets of predetermined plant conditions which favor plant control in one of the boiler follow and turbine follow modes. These sets of predetermined plant conditions permit the unit 38 to intelligently govern the selection of the desired one of the boiler follow or turbine follow modes and the switching operations correspondingly associated with the transfer therebetween is brought about by the turbine and boiler controls 28 and 20 under direction of the signals 46 and 44, respectively. One example of a logical gating arrangement in the preferred embodiment is depicted in the schematic of FIG. 2 utilizing the exemplary status signals 40 and 42 described hereinabove.

Referring to FIG. 2, signal 170 is coupled to the inputs of both an AND function 172 and an INVERTER function 174. Likewise, signal 154 is coupled to both one input of an AND function 176 and an INVERTER function 178. The outputs of the inverters 174 and 178 are provided to the other input of AND functions 176 and 172, respectively. The output signal 180 is one input to an OR function 182 and similarly, the output signal 184 of AND function 176 is one input to an OR function 186. Other inputs to OR function 182 comprise signals 156, 158 and 160. The output signal 187 of OR gate 182 is logically coupled to an input of an OR function 188. In an analogous arrangement, the other inputs of 186 are comprised of signals 162, 164, 166 and 168 and the output signal 189 of OR gate 186 is logically coupled to one input of an OR function 190. In addition, signals 192 and 194 are generated from the depression of push buttons PB1 and PB2 and are representative of turbine follow control mode and boiler follow control mode requests, respectively, originated preferably from an operator's control panel 36. Conventional permissive logic 196 is provided to condition signals 192 and 194 to generate mutually exclusive signals 198 and 200 which are representative of operator requests for turbine follow mode and boiler follow mode, respectively. Signals 198 and 200 are logically coupled to the other input of OR functions 188 and 190, respectively. Coventional transfer logic and memory function 202 is operative to generate the logical status of signals 44 and 46 as generated by the logical output status of OR functions 188 and 190. Signals 44 and 46 control the mode transfer switching operations associated with the boiler and turbine master controls 20 and 28, respectively, as described hereinabove.

In another aspect of the present embodiment, a signal 204 indicative of the depression of a push button PB3 preferably located on the operator's control panel 36 and constituting a request for plant operation in the ADS mode is conditioned by another permissive logic circuit 206 before coupling to one input of an OR function 208. The other input 210 to the OR function 208 may be left unconnected for use by plant operators as may be suitable for compliance to certain plant specifications. The output of OR gate 208 is coupled through an AND function 212 to provide an enabling signal 214 to the load demand controller 24. The ADS signal 216, which may be supplied to the controller 24 over a data link (not shown), for example, is tested by a valid signal determination function 218. Generally, the ADS signal 216 is a train of pulse width modulated pulses corresponding to the power generation desired by the network dispatcher. If a pulse width is determined to be longer than some predetermined amount by the validity checker 218, an indication may be provided over signal line 220. Likewise, if a pulse width of signal 216 is determined to be too short or if the signal 216 is terminated or disconnected without prior warning of intent or acknowledgement, the validity checker 218 may indicate such an invalid ADS input over signal line 222. Both signals 220 and 222 are supplied as inputs to a NOR function 224, the output of which is used to enable AND function 212 to pass the ADS request signal 214 to the load demand computer 24.

In summary then, an ADS request may be initiated from PB3 and if it is determined that the ADS signal 216 is valid by tester 218, an enabling signal 214 is provided to the load demand computer 24 causing the load demand signal 22 to be modulated from the ADS signal rather than from the panel controls 34. However, if an invalid ADS signal is present and detected by validity tester 218, one of the signals 220 and 222 may indicate the invalid condition which may be detected by NOR function 224. Under invalid condition, NOR gate 224 disables AND function 212 from gating the ADS request signal therethrough to the LDC 24. As a result, the ADS signal is rejected from modulating the signal 22 and further modulation of signal 22 is reverted to panel control signals 34. Therefore, the ADS signal 216 is permitted to modulate signal 22 upon request if it is determined that the ADS signal 216 is valid; otherwise, if an invalid signal generation condition is detected over lines 220 and 222, the ADS modulation of the power generation demand signal 22 is rejected.

According to the embodiment described in connection with FIG. 2, a boiler follow mode or a turbine follow mode may be intelligently selected by unit 38. In operation, OR function 182 responds to any one or more of the plurality of predetermined plant control conditions comprising: a condition in which the operation of a boiler auxiliary controller is being limited (lines 158 and 160); and a condition in which the boiler master controller 20 is in a manual control mode and the turbine master controller is in an automatic control mode as determined from signals 170 and 154 utilized gating arrangement 172 and 178, to request over signal 187 that a transfer to turbine follow mode be initiated. A request for transfer to the turbine follow mode may also be initiated from push button PB3 sending a request indication over signal line 198 which is "OR"ed with signal 187 in OR function 188. Transfer logic and memory circuit 202 reacts to the output of OR function 108 to establish a conventional signal status generation over signal lines 44 and 46 in accordance with a time relationship to cause a transfer from boiler follow mode to turbine follow mode in the boiler and turbine master controllers 20 and 28, respectively, while substantially maintaining the desired plant power generation level.

Similarly, OR function 186 responds to any one or more of the plurality of predetermined plant conditions comprising: a condition in which all of the steam admission valves are substantially wide open (162); a condition in which one or more of the steam admission valves is limited to a predetermined position value (164); a condition in which a turbine runback is in progress (166); a condition in which the turbine speed error is outside preset limits beyond a fixed time duration; and a condition in which the turbine controller 28 is in a manual control mode and the boiler controller 20 is in an automatic control mode as determined from signals 170 and 154 utilizing gating arrangement 174 and 176, to request over signal line 189 that a transfer to boiler follow mode be initiated. A request for transfer to the boiler follow mode may also be initiated from push button PB2 rendering a request indication over signal line 200 which is "OR"ed with signal 189 in OR function 190. Transfer logic and memory circuit 202 reacts to the output of OR function 190 to generate a signal status time relationship over signal lines 44 and 46 to effect a transfer from turbine follow mode to boiler follow mode in the boiler and turbine master controllers 20 and 28, respectively, while substantially maintaining the desired plant power generation level. For a more detailed description of the transfer operation reference is made to U.S. Pat. No. 3,925,645 which has been incorporated by reference herein.

It is understood that while the preferred embodiment has been described in connection with only a few of the plurality of possible plant control status signals which may be rendered by the boiler and turbine master controllers, it is not the intention of the present application to limit in any way the number and types of plant contrl status signals to those described. In addition, the sets of predetermined plant control conditions presented hereinabove are merely illustrative of the principles of the present invention and are not meant to limit the scope of applicants' invention. Rather, the present invention should be construed in accordance with the breadth and broad scope of the claims following this specification.

We claim:

1. In a steam turbine power plant having a boiler for generating steam to a steam turbine which is mechanically coupled to an electrical generator which generates electrical energy at a desired power generation level and including a boiler master controller for controlling boiler firing rate, said boiler controller being operative to generate a first plurality of status signals representative of plant control status; a turbine master controller for controlling a plurality of turbine steam admission valves, said turbine controller being operative to generate a second plurality of status signals representative of plant control status; said boiler and turbine master controllers being concurrently operative in one of a boiler follow and turbine follow control mode; and selecting means for switching the mode of control of said power plant between said boiler follow and turbine follow modes, a system for governing said selecting means comprising:

means for governing said selecting means to switch power plant control to said boiler follow control mode in accordance with a first set of predetermined plant control conditions established from said generated first and second plurality of status signals; and means for governing said selecting means to switch power plant control to said turbine follow control mode in accordance with a second set of predetermined plant control conditions established from said generated first and second plurality of status signals.

2. The system in accordance with claim 1 wherein the boiler and turbine master controllers are governed by a power generation demand signal which is modulated from a selected one of a plant control panel and an automatic dispatch system, said automatic dispatch system selection being dependent upon a set of predetermined permissives.

3. The system in accordance with claim 2 wherein the selection of said automatic dispatch system is rejected as a result of a detected invalid signal generation condition.

4. The system in accordance with claim 1 wherein both the boiler and turbine master controllers include means for controlling the transfer between boiler follow and turbine follow control modes without substantially disturbing plant energy generation at a desired power generation level.

5. The system in accordance with claim 1 wherein the first set of predetermined plant control conditions includes a condition in which all of the turbine steam admission valves are substantially wide open, a condition in which a steam turbine admission valve is limited to a predetermined position valve, a condition in which a turbine runback is in progress, a condition in which a turbine speed error is outside preset limits beyond a fixed time duration, and a condition in which the turbine controller is in a manual control mode and the boiler controller is in an automatic control mode.

6. The system in accordance with claim 5 wherein the selecting means is governed to switch to the boiler follow control mode upon the detected occurrence of at least one of said first set of predetermined plant control conditions.

7. The system in accordance with claim 6 including means in both the boiler and turbine master controllers to control the transfer to the boiler follow control mode without substantially disturbing plant energy generation at a desired power generation level.

8. The system in accordance with claim 1 wherein the second set of predetermined plant control conditions includes a condition in which the operation of a boiler auxiliary controller of the boiler master controller is being limited, a condition in which a boiler runback is in progress, and a condition in which the boiler master controller is in a manual control mode and the turbine master controller is in an automatic control mode.

9. The system in accordance with claim 8 wherein the selecting means is governed to switch to the turbine follow control mode upon the detected occurrence of at least one of said second set of predetermined plant control conditions.

10. The system in accordance with claim 9 including means in both the boiler and turbine master controller to control the transfer to the turbine follow mode without substantially disturbing plant energy generation at a desired power generation level.

* * * * *